US008323863B2

(12) United States Patent
Watanabe et al.

(10) Patent No.: US 8,323,863 B2
(45) Date of Patent: Dec. 4, 2012

(54) IMAGE FORMING METHOD, IMAGE FORMING DEVICE, AND LIGHT-IRRADIATION-FUSIBLE TONER SET

(75) Inventors: Miho Watanabe, Kanagawa (JP); Takashi Matsubara, Kanagawa (JP); Shinji Hasegawa, Kanagawa (JP); Makoto Furuki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 678 days.

(21) Appl. No.: 12/537,747

(22) Filed: Aug. 7, 2009

(65) Prior Publication Data

US 2010/0248117 A1 Sep. 30, 2010

(30) Foreign Application Priority Data

Mar. 26, 2009 (JP) ..... 2009-077345

(51) Int. Cl.
*G03G 13/20* (2006.01)
*G03G 15/08* (2006.01)

(52) U.S. Cl. ..... 430/107.1; 430/124.1; 399/321

(58) Field of Classification Search ..... 430/107.1, 430/124.1; 399/321
See application file for complete search history.

(56) References Cited

U.S. PATENT DOCUMENTS 6,248,488 B1 6/2001 Kinoshita et al.
7,910,733 B2 * 3/2011 Tian et al. ..... 544/249
8,097,390 B2 * 1/2012 Yanagida ..... 430/108.21
2003/0186143 A1 * 10/2003 Katagiri et al. ..... 430/45
2004/0142263 A1 * 7/2004 Mikuriya et al. ..... 430/108.2
2006/0018688 A1 * 1/2006 Nakamura et al. ..... 399/336

FOREIGN PATENT DOCUMENTS

JP A-05-341560 12/1993
JP A-11-265094 9/1999
JP A-2007-140177 6/2007
JP A-2007-248819 9/2007
JP A-2010-230847 10/2010

OTHER PUBLICATIONS

Japanese Office Action issued in Japanese Patent Application No. 2009-077345 dated Aug. 16, 2011 (with translation).

* cited by examiner

*Primary Examiner* — Hoa V Le
(74) *Attorney, Agent, or Firm* — Oliff & Berridge, PLC

(57) ABSTRACT

An image forming method includes forming at least one electrostatic charge image on at least one image holding member, developing the at least one electrostatic charge image using a black toner and a color toner to form toner images, transferring toner images to a receiving body, and fixing the toner images by light-irradiation fusing, the black toner being melted in the light-irradiation fusing, the color toner containing an infrared absorber, a light absorptance of the color toner at a peak wavelength of the light irradiated in the light-irradiation fusing being from about 79% to about 98% of a light absorptance of the black toner at the peak wavelength, and the color difference ΔE of the color toner due to the presence or absence of the infrared absorber is in a specific range.

5 Claims, 4 Drawing Sheets

IMAGE FORMING METHOD, IMAGE FORMING DEVICE, AND LIGHT-IRRADIATION-FUSIBLE TONER SET

CROSS-REFERENCE TO RELATED APPLICATION

This application is based on and claims priority under 35 USC 119 from Japanese Patent Application No. 2009-077345 filed on Mar. 26, 2009.

BACKGROUND

1. Technical Field

The present invention relates to an image forming method, an image forming device, and a light-irradiation-fusible toner set.

2. Related Art

In an electrophotographic image forming method and an electrophotographic image forming device, a heat roll fusing system is employed as a toner image fixing method. In this heat roll fusing system, a printed material, such as paper on which an image has been formed by a toner, is passed between heat rolls, and the toner image on the printed matter is fixed by applying heat and pressure from the heat rolls.

In contrast, as a non-contact fusing system, a fixing method has been used in which a toner that forms a toner image on a receiving body (recording sheet or the like) is fixed by heating and melting. In a technique applied to the non-contact fusing system, a fusing device is used in which a flash lamp is provided so that the flash lamp faces a conveyance path of a receiving body, and an intermittent light is applied by the flash lamp to heat and melt a toner on the receiving body while it is being conveyed. In the fusing system using a flash lamp, various types of paper can be used and high speed fixing can be easily achieved due to a non-contact system, as compared to the heat roll fusing system.

With a recent reduction in price and increase in output of a semiconductor laser, a fusing system using a high-output semiconductor laser in place of a flash lamp has been tested, and it is thought that semiconductor lasers could replace flash lamps as a light source for fusing.

SUMMARY

According to an aspect of the invention, an image forming method includes:

forming at least one electrostatic charge image on a surface of at least one image holding member;

developing the at least one electrostatic charge image using a light-irradiation-fusible black toner and a light-irradiation-fusible color toner to form a black toner image and a color toner image;

transferring the black toner image and the color toner image to a surface of a receiving body; and fixing the black toner image and the color toner image transferred to the surface of the receiving body by light-irradiation fusing with irradiation of light in the infrared region, the black toner being melted by the irradiation of the light in the infrared region in the light-irradiation fusing, the color toner containing an infrared absorber, a light absorptance of the color toner at a peak wavelength of the light in the infrared region irradiated in the light-irradiation fusing being from 79% to 98% (or about from 79% to about 98%) of a light absorptance of the black toner at the peak wavelength, and the color toner having a color difference ΔE represented by the following Equation (1) of 20 or less (or about 20 or less), $$\Delta E\{(L_1-L_2)^2+(a_1-a_2)^2+(b_1-b_2)^2\}^{1/2}, \quad \text{Equation (1)}$$

in Equation (1), $L_2$, $a_2$, and $b_2$ representing an L value, an a value, and a b value of the light-irradiation-fusible color toner in a fixed image, and $L_1$, $a_1$, and $b_1$ representing an L value, an a value, and a b value of a color toner obtained by excluding the infrared absorber from the light-irradiation-fusible color toner, in a fixed image.

BRIEF DESCRIPTION OF THE DRAWINGS

Exemplary embodiments of the present invention will be described in detail based on the following figures, wherein.

DETAILED DESCRIPTION

Figure 1:
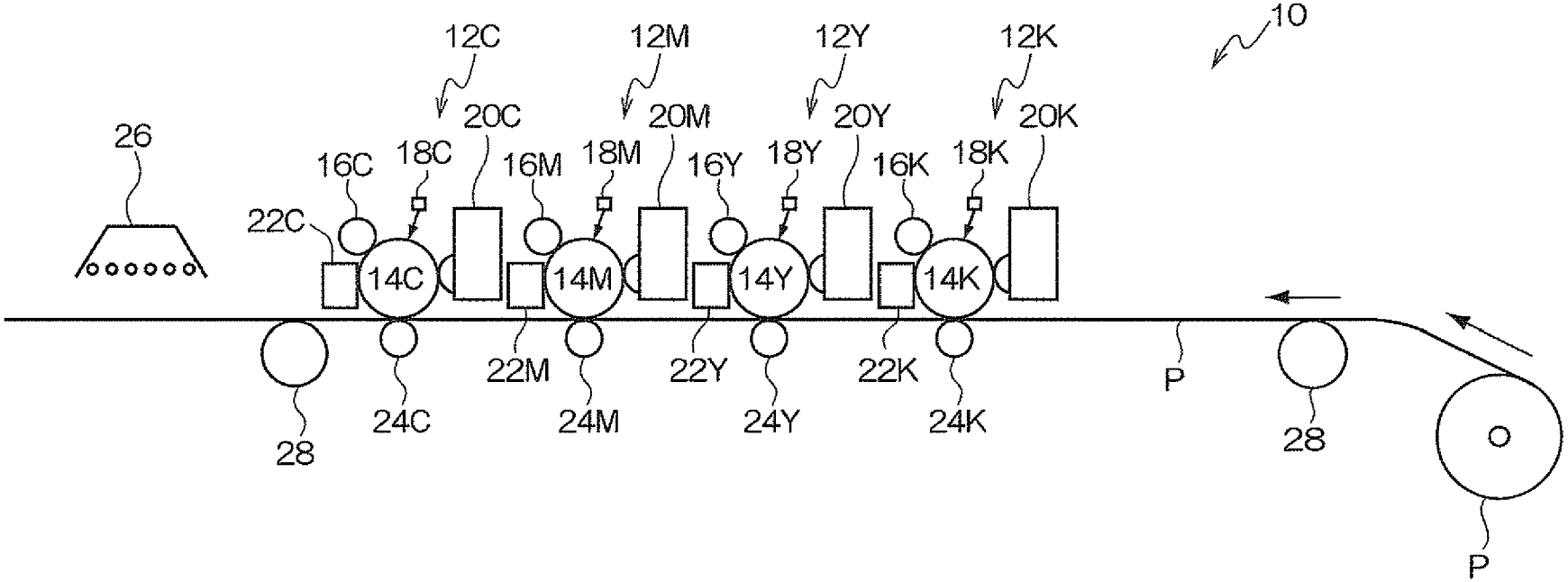
FIG. 1 is a schematic configuration diagram illustrating an example of an image forming device according to an exemplary embodiment of the invention.

Hereinafter, embodiments of the invention will be described in detail.

First Exemplary Embodiment

Light-Irradiation-Fusible Toner Set

A light-irradiation-fusible toner set according to a first exemplary embodiment of the invention (hereinafter the "light-irradiation-fusible toner set" is also referred to as a "toner set") contains a light-irradiation-fusible black toner (hereinafter the light-irradiation-fusible black toner is also referred to as a "black toner") that absorbs light in the infrared region and a light-irradiation-fusible color toner (hereinafter the light-irradiation-fusible color toner is also referred to as a "color toner") that absorbs light in the infrared region, the color toner containing an infrared absorber, the light absorptance of the color toner at the wavelength corresponding to the maximum light absorption peak thereof in the infrared region being from 79% to 98% (or from about 79% to about 98%) of the light absorptance of the black toner at the same wavelength, and the color toner having a color difference ΔE represented by the following Equation (1) of 20 or less (or about 20 or less).

$$\Delta E\{(L_1-L_2)^2+(a_1-a_2)^2+(b_1-b_2)^2\}^{1/2}, \quad \text{Equation (1)}$$

In Equation (1), $L_2$, $a_2$, and $b_2$ representing, respectively, the L value, the a value, and the b value of the light-irradiation-fusible color toner in a fixed image, and $L_1$, $a_1$, and $b_1$ representing, respectively, the L value, the a value, and the b value of a color toner obtained by excluding the infrared absorber from the light-irradiation-fusible color toner, in a fixed image.

The black toner and the color toner in the toner set according to the first exemplary embodiment of the invention are used as a toner for forming a toner image by developing an electrostatic latent image in an image forming method and an image forming device. The black toner and the color toner are toners that are melted by light energy when light in the infrared region is irradiated thereto, and are thereby fixed to a surface of a receiving body (that is, they are fixed to the surface of the receiving body by a light-irradiation fusing system).

In a conventional image forming method and an image forming device using a light-irradiation fusing system in which a multicolor image is formed by using a black toner and a color toner, the following phenomenon has occurred when only one light source is used as a light source for fusing a black toner and a color toner.

(1) When a light source is set in such a manner as to emit irradiation energy sufficient for fusing the color toner, the irradiation energy is excessively large for the black toner, and thus the black toner is excessively heated, resulting in the development of a void (a white patch in an image).

(2) When a light source is set so that the irradiation energy does not cause the development of a void at the time of fusing of the black toner, fusibility of the color toner deteriorates.

(3) However, when the concentration of the infrared absorber is increased so as to increase the light absorptance in the infrared region of the color toner to as high as that of the black toner, the light absorption in the visible region by the infrared absorber also increases, which deteriorates the color quality of the color toner.

Therefore, in a color toner for use in the light-irradiation fusing system, it has been thought impossible to be obtain both of excellent fusibility thereof under exposing conditions sufficient for fusing the black toner, and suppression of color quality deterioration of a fixed image.

The present inventors have investigated the relationship between the light absorptance and the fusibility of a color toner in a light-irradiation fusing system, such as flash fusing or laser fusing. Specifically, it has been found that a color toner may be sufficiently fused to an extent similar to that of a black toner under exposing conditions preferable for fusing the black toner, without increasing the light absorptance of the color toner in the infrared region to as high as that of the black toner. Moreover, it has been found that since a high light absorptance comparable to that of the black toner is not required for the color toner, the amount of the infrared absorber added to the color toner may be reduced and color quality deterioration of the color toner may be suppressed.

The "light in the infrared region" as used herein refers to light in a wavelength region of from 770 nm to 1000 nm.

The "black toner" as used herein refers to a toner in which the minimum light absorptance in the visible region (wavelength region of from 400 nm to 700 nm) is 80% or more.

The "color toner" as used herein refers to a toner that is other than the black toner and that can reflect light of a wavelength in the visible region.

The "infrared absorber" as used herein refers to an additive, the maximum light absorption peak of which is in the infrared region. Therefore, the "color toner obtained by excluding the infrared absorber from the light-irradiation-fusible color toner", which is used as a basis for comparison in determining the color difference ΔE represented by Equation (1), refers to a toner excluding any additive, the maximum light absorption peak of which is in the infrared region, from the color toner in the toner set according to the first exemplary embodiment of the invention.

The term "set" in the phrase "toner set" as used herein refers to a combination of toners that are loaded together on one multicolor image forming device. In order to address the above issues, the toner set according to an exemplary embodiment of the invention is used by loading a combination of toners together on one multicolor image forming device. Therefore, the "set" does not necessarily mean a combination of one or more black toners and one or more color toners. Accordingly, when the present invention is actually sold, it does not necessarily include both black and color toner, and such a product is also within the scope of the present invention.

—Light Absorptance Ratio between Color Toner and Black Toner—

The toner set according to the first embodiment of the invention contains the black toner and the color toner. The light absorptance of the color toner at the wavelength corresponding to the maximum light absorption peak thereof in the infrared region is from 79% to 98% (or from about 79% to about 98%) of the light absorptance of the black toner at this wavelength. In other words, the light absorptance ratio of the color toner to the black toner at the above wavelength is in the region of from 0.79 to 0.98 (or from about 0.79 to 0.98). When the light absorptance ratio is more than 0.79, excellent fusibility may be obtained. When the light absorptance ratio is less than 0.98, deterioration in the color quality may be suppressed.

The light absorptance ratio is preferably in the range of from 0.79 to 0.96 and more preferably from 0.79 to 0.89.

Here, the light absorptance of the color toner at the wavelength corresponding to the maximum light absorption peak thereof in the infrared region, and the light absorptance of the black toner at this wavelength are calculated by measuring a reflection spectrum. The reflection spectrum is obtained with a spectrophotometer (trade name: U-4100, manufactured by Hitachi, Ltd.).

The "light absorptance" (of each toner) as used herein refers to the light absorptance of the toner after the toner is fused to a surface of a receiving body. More specifically, the "light absorptance" refers to the light absorptance of a printed image and the printed image is a black color image if the toner to be measured is a black toner, a yellow color image if the toner to be measured is a yellow toner, a magenta color image if the toner to be measured is a magenta toner, or a cyan color image if the toner to be measured is a cyan toner.

The light absorptance of the color toner in the infrared region can be adjusted, for example, by selecting the type or adjusting the content of the infrared absorber. The light absorptance of the black toner in the infrared range can be adjusted, for example, by selecting the type thereof or adjusting the content of a black colorant such as a carbon black. When a colorant that does not have an absorption peak in the infrared region (for example, process black or the like) is used, the light absorptance can be adjusted, for example, by selecting the type or adjusting the content of the infrared absorber.

—Light Absorptance—

In the color toner in the toner set according to the first exemplary embodiment of the invention, the light absorptance of the color toner at the wavelength corresponding to the maximum light absorption peak thereof in the infrared region is preferably from 75% to 93% (or from about 75% to about 93%). When the light absorptance of the color toner is 75% or more, excellent fusibility may be obtained. When the light absorptance of the color toner is 93% or less, color quality deterioration may be suppressed. The light absorptance of the color toner at the above wavelength is more preferably from 75% to 90% and still more preferably from 75% to 85%.

The black toner in the toner set according to the first exemplary embodiment of the invention has a light absorptance at the above wavelength (the wavelength at which the color toner exhibits the maximum light absorption peak in the infrared region) of preferably from 79% to 98% (or from about 79% to about 98%).

—Color difference ΔE—

The color toner in the toner set according to the first exemplary embodiment of the invention has a color difference ΔE represented by Equation (1) of 20 or less (or about 20 or less). When the color difference ΔE is 20 or less, favorable color quality may be obtained.

The color difference ΔE is preferably 15 or less, and more preferably 10 or less.

Here, the color difference ΔE is calculated by the following method.

First, a fixed image of the color toner in the toner set according to the first embodiment of the invention is obtained. A light-irradiation fusing device equipped with a light source (trade name: HIGHLIGHT ISL-2000L, manufactured by COHERENT; exposure wavelength: 808 nm) is used for fixing to obtain the fixed image. The irradiation energy for the light-irradiation fusing is 1.0 J/cm$^2$.

Subsequently, a fixed image is obtained using a toner obtained by excluding an infrared absorber from the color toner. The fixed image is obtained by fixing, in which the paper to which the toner has been transferred is sandwiched between Teflon (registered trademark) sheets and then passed through a pouch laminator (trade name: GLM2500, manufactured by GBC JAPAN K.K.) at a speed set to level 1 and a temperature set to 120° C.

The color of the fixed image of the color toner containing the infrared absorber and the color of the fixed image of the color toner not containing the infrared absorber are evaluated, using a reflection spectrodensitometer (trade name: X-RITE 939, manufactured by X rite Incorporated), by measuring the values of each of $L_1$, $a_1$, and $b_1$, $L_2$, $a_2$, and $b_2$ in Equation (1) and Calculating the Color Difference ΔE.

Here, ΔE is a color difference as indicated in the CIE1976 L*a*b* colorimetric system. A larger value of ΔE indicates a larger apparent difference in the two colors to be compared.

The color difference ΔE of the color toner in the toner set according to the first exemplary embodiment of the invention can be adjusted, for example, by selecting the type or adjusting the content of the infrared absorber Color Toner Hereinafter, preferable examples of components of the color toner in the toner set according to the first exemplary embodiment of the invention will be described.

—Infrared Absorber—

The color toner of the exemplary embodiment of the invention may include a known infrared absorber, the maximum absorption of which is in the infrared region (from 770 nm to 1000 nm), may be used. Preferable examples of the infrared absorber include a squarylium dye, a croconium dye, a naphthalocyanine dye, a cyanine dye, and an aminium dye.

The addition amount of the infrared absorber is adjusted such that the infrared absorption of the color toner after addition of the infrared absorber is in a predetermined range, and is preferably from 0.3 parts by weight to 1.0 part by weight (or from about 0.3 parts by weight to about 1.0 part by weight) in total, with respect to 100 parts by weight of the color toner.

—Binder Resin—

The color toner of the exemplary embodiment of the invention may include a known binder resin. Preferable examples of a main component of the binder resin include polyester and polyolefin. Examples of the binder resin include a copolymer of styrene and acrylic acid, a copolymer of styrene and methacrylic acid, a copolymer of styrene and acrylic acid ester, a copolymer of styrene and methacrylic acid ester, polyvinyl chloride, a phenol resin, an acrylic resin, a methacrylic resin, polyvinyl acetate, a silicone resin, a polyester resin, polyurethane, a polyamide resin, a furan resin, an epoxy resin, a xylene resin, polyvinyl butyral, a terpene resin, a cumarone-indene resin, a petroleum resin, and a polyether polyol resin. The binder resin may be used singly, or in combination of two or more kinds thereof. Among them, a polyester resin and a norbornene polyolefin resin are preferable.

The Tg (glass transition temperature) of the binder resin used for the toner is preferably in the range of from 50° C. to 70° C.

—Colorant—

The color toner of the exemplary embodiment of the invention may include a known colorant. The colorant is selected in accordance with the color of the toner for use.

Examples of the colorant used for a cyan toner include C. I. pigment blue 1, 2, 3, 4, 5, 6, 7, 10, 11, 12, 13, 14, 15, 15:1, 15:2, 15:3, 15:4, 15:6, 16, 17, 23, 60, 65, 73, 83, and 180, C. I. vat cyan 1, 3, and 20, Prussian Blue, cobalt blue, alkali blue lake, phthalocyanine blue, non-metallic phthalocyanine blue, a partially chlorinated product of phthalocyanine blue, Fast Sky Blue, cyan pigments such as Indanthrene Blue BC, and cyan dyes such as C. I. solvent cyan 79 and 162, Among them, C.I. pigment blue 15:3 is preferable.

Examples of the colorant used for a magenta toner include C. I. pigment red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 184, 202, 206, 207, and 209; magenta pigments such as pigment violet 19; magenta dyes such as C. I. solvent red 1, 3, 8, 23, 24, 25, 27, 30, 49, 81, 82, 83, 84, 100, 109, and 121, C. I. disper red 9, and C. I. basic red 1, 2, 9, 12, 13, 14, 15, 17, 18, 22, 23, 24, 27, 29, 32, 34, 35, 36, 37, 38, 39, and 40; Iron Oxide Red, cadmium red, red lead, mercury sulfide, Permanent Red 4R, Lithol Red, Pyrazolone red, Watchung Red, calcium salt, lake red D, Brilliant Carmin 6B, Bosine Lake, Rhodamine Lake B, Alizarin Lake, and Brilliant Carmine 3B.

Examples of the colorant used for a yellow toner include yellow pigments such as C. I. pigment yellow 2, 3, 15, 16, 17, 97, 180, 185, and 139.

The addition amount of each colorant is preferably in the range of from 1 part by weight to 20 parts by weight with respect to 100 parts by weight of a color toner produced by mixing with the binder resin or the like.

—Other Additives—

The color toner of the exemplary embodiment of the invention may include a charge controlling agent and/or a wax, if necessary.

Examples of the charge controlling agent include known calixarenes, nigrosine dyes, quaternary ammonium salts, amino group-containing polymers, metal-containing azo dyes, complex compounds of salicylic acid, phenolic compounds, azo-chromium complexes, and azo-zinc complexes. The toner of the exemplary embodiment may be used as a magnetic toner by incorporating magnetic materials such as iron powder, magnetite or ferrite. In particular, in the case of the color toner, white magnetic powder may be used.

As the wax, an ester wax, polyethylene, polypropylene, or a copolymer of polyethylene and polypropylene may be used. Examples of the wax include saturated fatty acids such as polyglyceryl waxes, microcrystalline waxes, paraffin waxes, carnauba waxes, Sasol wax, montanic acid ester waxes and deoxidized carnauba waxes, palmitic acid, stearic acid, and montanic acid; unsaturated fatty acids such as brassidic acid, eleostearic acid and parinaric acid; saturated alcohols such as stearyl alcohol, aralkyl alcohols, behenyl alcohol, carnaubyl alcohol, ceryl alcohol, mericyl-alcohol and long-chain alkyl alcohols having a longer-chain alkyl group; polyhydric alcohols such as sorbitol; fatty acid amides such as linoleic acid amide, oleic acid amide and lauric acid amide; saturated fatty acid bisamides such as methylenebisstearic acid amide, ethylenebiscaprinic acid amide, ethylenebislauric acid amide and hexamethylenebisstearic acid amide; unsaturated fatty acid amides such as ethylenebisoleic acid amide, hexamethylenebisoleic acid amide, N,N'-dioleyladipic acid amide and N,N'-dioleylsebacic acid amide; aromatic bisamides such as m-xylenebisstearic acid amide and N,N'-distearylisophthalic acid amide; fatty acid metal salts (generally referred to as metal soaps) such as calcium stearate, calcium laurate, zinc stearate and magnesium stearate; aliphatic hydrocarbon waxes grafted with a vinyl monomer such as styrene or acrylic acid; partially-esterified compounds of fatty acid and polyhydric alcohol such as behenic acid monoglyceride; and hydroxyl group-containing methyl ester compounds obtained by hydrogenation of a vegetable oil or the like.

The wax may be a wax material exhibiting an endothermic peak at a temperature in the range of from 50° C. to 90° C. in DSC measurement (differential scanning calorimetry). In terms of a measurement principle, the DSC measurement is preferably performed with a high-precision power compensation differential scanning calorimeter.

—Method for Producing Color Toner—

For producing the color toner, a generally-used kneading and pulverizing method or a wet granulation method may be used. Here, examples of the wet granulation method include a suspension polymerization method, an emulsion polymerization method, an emulsion aggregation method, a soap-free emulsion polymerization method, a non-aqueous dispersion polymerization method, an in-situ polymerization method, an interfacial polymerization method and an emulsion dispersion granulation method.

The color toner may be produced by the kneading and pulverizing method, for example, by thoroughly mixing the binder resin, the infrared absorber, the wax, the charge controlling agent, the pigment or dye as the colorant, other additives and the like by using a mixer such as a Henschel mixer or a ball mill, melt-kneading the mixture using a heat kneading machine such as a heat roll, a kneader, or an extruder to allow resins to be mutually dissolved, dispersing or dissolving the infrared absorber, an antioxidant, the pigment, the dye, the magnetic material or the like in the resultant, and solidifying the resulting dispersion or solution by cooling, followed by pulverization and classification to obtain the toner. In order to improve the dispersibility of the pigment or the infrared absorber, a masterbatch may be used.

The infrared absorber may be added to the toner by dispersing the infrared absorber into the color toner as described above or may be added to the toner by adhering or fixing the infrared absorber to the surfaces of toner particles.

—Physical Properties of Color Toner—

The volume average particle diameter D50v of the color toners produced as described above is preferably from 3 μm to 10 μm (or from about 3 μm to about 10 μm) and more preferably from 4 μm to 8 μm (or from about 4 μm to about 8 μm).

The ratio (D50 v/D 50p) of the volume average particle diameter D50v to the number average particle diameter D50p is preferably in the range of from 1.0 to 1.25.

When toner particles are produced by the wet granulation method, the shape factor SF1 of the toner particles is preferably from 110 to 135.

The toner shape factor SF1 is obtained by capturing optical microscope images of the toner particles sprayed on a slide glass into a LUZEX image analyzer through a video camera, determining the maximum length and projected area of each of 50 or more toner particles, calculating SF1 for each toner particle based on the following Equation (2), and determining the average value of the SF 1 values of the 50 or more toner particles.

$$SF1(ML^2/A)\times(\pi/4)\times 100 \qquad \text{Equation (2)}$$

In Equation (2), ML and A respectively represent the absolute maximum length and the projected area of a toner particle.

The volume particle size distribution index GSDv of the toner particles is preferably 1.25 or less.

The volume average particle diameter of the toner and the particle size distribution index are measured with COULTER COUNTER Model TAII (manufactured by BECKMAN COULTER) using ISOTON-II (manufactured by BECKMAN COULTER) as an electrolyte.

First, on the basis of the measured particle size distribution of the toner, volumes and numbers in particle size ranges (channels) are plotted in respective cumulative distributions, accumulating from the small diameter side. Particle diameters for accumulations of 16% are defined as a cumulative volume average particle diameter D16v and a cumulative number average particle diameter D16p, particle diameters for accumulations of 50% are defined as a cumulative volume average particle diameter D50v (this volume is considered to be a volume average particle diameter of the toner described above) and a cumulative number average particle diameter D50p, and particle diameters or accumulations of 84% is defined as a cumulative volume average particle diameter D84v and a cumulative number average particle diameter D84p. Using these, the volume particle size distribution index (GSDv) is calculated as D84v/D16v.

—External Additive—

The color toner of the exemplary embodiment of the invention may be prepared by mixing inorganic particles with toner particles. The inorganic particles may be white inorganic particles. The proportion of the inorganic particles to be mixed with the toner particles is preferably from 0.01 parts by weight to 5 parts by weight and preferably from 0.01 parts by weight to 2.0 parts by weight, with respect to 100 parts by weight of the toner particles (excluding the inorganic particles). Examples of the inorganic particles include silica powder, alumina, titanium oxide, barium titanate, magnesium titanate, calcium titanate, strontium titanate, zinc oxide, silica sand, clay, mica, wollastonite, diatomaceous earth, chromium oxide, cerium oxide, iron oxide red, antimony trioxide, magnesium oxide, zirconium oxide, barium sulfate, barium carbonate, calcium carbonate, silicon carbide and silicon nitride. Among them, silica powder is preferable. In addition, known materials such as silica, titanium, resin powder or alumina may be used singly, or in combination with these inorganic particles.

A cleaning activator may be added as an external additive, such as a metal salt of a higher fatty acid such as zinc stearate or powdery particle of fluoropolymer.

The toner is obtained by being thoroughly mixed with the inorganic particles or other additives by using a mixer such as a Henschel mixer.

Black Toner

Hereinafter, a preferable composition of the black toner in the toner set according to the first exemplary embodiment of the invention will be described.

A black toner similar in composition to the color toner described in the above section "Color toner", but in which the colorant in the color toner is changed to a black colorant, may also be used.

When the light absorptance of the black toner in the infrared region is sufficient, the infrared absorber does not need to be added. When the infrared absorber is added to the black toner, the addition amount of the infrared absorber is preferably from 0.01 parts by weight to 5 parts by weight in total, with respect to 100 parts by weight of the black toner Examples of the colorant used for the black toner include carbon black, activated carbon, titanium black, magnetic powder and Mn-containing nonmagnetic powder. A black toner in which a yellow, magenta, cyan, red, green, or blue pigment has been mixed may be used.

Carrier

The color toner or the black toner in the toner set according to the first exemplary embodiment may be mixed with a carrier to form a two-component developer. Examples of the carrier include a resin coated carrier having a resin coating layer on the surface of a core material. Examples of the core material include a known magnetite, ferrite, and iron powder The coating agent for the carrier is not limited, and a coating agent containing a silicone resin is preferable.

Second Exemplary Embodiment

Image Forming Method

Third Exemplary Embodiment

Image Forming Device

An image forming method according to a second exemplary embodiment of the invention includes: forming at least one electrostatic charge image on a surface of at least one image holding member; developing the at least one electrostatic charge image using a light-irradiation-fusible black toner and a light-irradiation-fusible color toner to form a black toner image and a color toner image; transferring the black toner image and the color toner image to a surface of a receiving body; and fixing the black toner image and the color toner image transferred to the surface of the receiving body by light-irradiation fusing by irradiating light in the infrared region, the black toner being melted by the irradiation of the light in the infrared region in the light-irradiation fusing, the color toner containing an infrared absorber, the light absorptance of the color toner at the peak wavelength of the light in the infrared region irradiated in the light-irradiation fusing being from 79% to 98% (or from about 79% to about 98%) of the light absorptance of the black toner at the same wavelength, and the color toner having a color difference ΔE represented by the following Equation (1) of 20 or less (or about 20 or less).

An image forming device according to a third exemplary embodiment of the invention includes: at least one image holding member; at least one electrostatic charge image forming device that forms at least one electrostatic charge image on a surface of the at least one image holding member; at least one developing device that develops the at least one electrostatic charge image using a light-irradiation-fusible black toner and a light-irradiation-fusible color toner to form a black toner image and a color toner image; at least one transfer device that transfers the black toner image and the color toner image to a surface of a receiving body; and at least one light-irradiation fusing device that fixes the black toner image and the color toner image transferred to the surface of the receiving body by light-irradiation fusing with irradiation of light in the infrared region, the black toner being melted by the irradiation of the light in the infrared region in the light-irradiation fusing, the color toner containing an infrared absorber, the light absorptance of the color toner at the peak wavelength of the light in the infrared region irradiated in the light-irradiation fusing being from 79% to 98% (or from about 79% to about 98%) of the light absorptance of the black toner at the same wavelength, and the color toner having a color difference ΔE represented by the following Equation (1) of 20 or less (or about 20 or less).

$$\Delta E\{(L_1-L_2)^2+(a_1-a_2)^2+(b_1-b_2)^2\}^{1/2}, \qquad \text{Equation (1)}$$

In Equation (1), $L_2$, $a_2$, and $b_2$, respectively, represent the L value, the a value, and the b value of the light-irradiation-fusible color toner in a fixed image, and $L_1$, $a_1$, and $b_1$, respectively represent the L value, the a value, and the b value of a color toner obtained by excluding the infrared absorber from the light-irradiation-fusible color toner, in a fixed image.

—Light Absorptance Ratio between Color Toner and Black Toner—

In the image forming method according to the second exemplary embodiment or the image forming device according to the third exemplary embodiment, an image is formed using a black toner and a color toner. The light absorptance of the color toner at the peak wavelength of the light in the infrared region irradiated by the light-irradiation fusing device is from 79% to 98% (or from about 79% to about 98%) of the light absorptance of the black toner at this wavelength. In other words, the light absorptance ratio of the color toner to the black toner at the above wavelength is in the region of from 0.79 to 0.98 (or from about 0.79 to 0.98). When the light absorptance ratio is more than 0.79, excellent fusibility may be obtained. When the light absorptance ratio is less than 0.98, color quality deterioration may be suppressed.

The light absorptance ratio is preferably in the range of from 0.79 to 0.96 and more preferably from 0.79 to 0.89.

Here, the light absorptance of the color toner at the peak wavelength of the light in the infrared region irradiated by the light-irradiation fusing device and the light absorptance of the black toner at this wavelength are calculated by measuring a reflection spectrum. The reflection spectrum is obtained with a spectrophotometer (trade name: U-4100, manufactured by Hitachi, Ltd.) using a light source for use in the image forming method according to the second exemplary embodiment (a light source for irradiating light in the infrared region) or the image forming device according to the third exemplary embodiment.

—Light Absorptance—

In the image forming method according to the second embodiment and the image forming device according to the third embodiment, the light absorptance of the color toner at the peak wavelength of the light in the infrared region irradiated by the light-irradiation fusing device is preferably from 75% to 93%. When the light absorptance of the color toner is 75% or more, excellent fusibility may be obtained. When the light absorptance is 93% or less, color quality deterioration may be suppressed. The light absorptance is more preferably from 75% to 90% and more preferably from 75% to 85%.

In the image forming method according to the second exemplary embodiment or the image forming device according to the third exemplary embodiment, the light absorptance of the black toner at the wavelength (the peak wavelength of the light in the infrared region irradiated by the light-irradiation fusing device) is preferably from 79% to 98%.

—Color Difference ΔE—

In the image forming method according to the second exemplary embodiment or the image forming device according to the third exemplary embodiment, the color toner has a color difference ALE represented by Equation (1) of 20 or less. When the color difference ΔE is 20 or less, favorable color quality may be obtained.

The color difference ΔE is preferably 15 or less and more preferably 10 or less.

In the image forming method according to the second exemplary embodiment or the image forming device according to the third exemplary embodiment, the black toner and the color toner in the toner set according to the first exemplary embodiment are preferably used as the black toner and the color toner in order to satisfy the above requirements.

—Light Source—

Examples of the light source (fixing member) used in the light-irradiation fusing device used in the image forming method according to the second exemplary embodiment or the image forming device according to the third exemplary embodiment include ordinary light sources such as a halogen lamp, a mercury lamp, a flash lamp, and an infrared laser. Among them, an infrared laser is preferable from the viewpoint of monochromaticity or power of the light source. Examples of the infrared laser include a semiconductor laser, a dye laser, a titanium sapphire laser, and an OPO laser. The irradiation energy of the light source is preferably in the range of from 0.1 J/cm$^2$ to 7.0 J/cm$^2$ and more preferably from 0.5 J/cm$^2$ to 6.0 J/cm$^2$.

Hereinafter, an example of the image forming device will be described with reference to the drawings. FIG. 1 is a schematic configuration diagram showing an example of the image forming device according to the third exemplary embodiment of the invention using the image forming method according to the second exemplary embodiment of the invention.

In the image forming device 10 shown in FIG. 1, a rolled recording medium (a receiving body) P is conveyed by paper feed rollers 28. Over one side of the conveyed recording medium P, four image forming units 12K (black), 12Y (yellow), 12M (magenta), and 12C (cyan) are provided in parallel from the upstream to the downstream relative to a conveyance direction of the recording medium P. A fixing unit (light-irradiation fusing device) 26 for light-irradiation fusing is provided at the downstream side of the image forming units 12K, 12Y, 12M and 12C.

The image forming unit 12K for black is a known electrophotographic image forming unit. Specifically, a charging device 16K, an exposure unit (electrostatic latent image forming device) 18K, a developing unit (developing device) 20K and a cleaning device 22K are provided around a photoreceptor (image holding member) 14K, and a transfer unit (transfer device) 24K is provided opposite to the photoreceptor 14K with respect to the recording medium P.

The image forming unit 12Y for yellow is a known electrophotographic image forming unit. Specifically, a charging device 16Y an exposure unit (electrostatic latent image forming device) 18Y, a developing unit (developing device) 20Y and a cleaning device 22Y are provided around a photoreceptor (image holding member) 14Y; and a transfer unit (transfer device) 24Y is provided opposite to the photoreceptor 14Y with respect to the recording medium P.

The image forming unit 12M for magenta is a known electrophotographic image forming unit. Specifically, a charging device 16M, an exposure unit (electrostatic latent image forming device) 18M, a developing unit (developing device) 20M and a cleaning device 22M are provided around a photoreceptor (image holding member) 14M, and a transfer unit (transfer device) 24M is provided opposite to the photoreceptor 14M with respect to the recording medium P.

The image forming unit 12C for cyan is a known electrophotographic image forming unit. Specifically, a charging device 16C, an exposure unit (electrostatic latent image forming device) 18C, a developing unit (developing device) 20C and a cleaning device 22C are provided around a photoreceptor (image holding member) 14C, and a transfer unit (transfer device) 24C is provided opposite to the photoreceptor 14C with respect to the recording medium P.

Here, the photoreceptors 14K, 14Y, 14M and 14C may be inorganic photoreceptors using an inorganic photoconductive material such as amorphous silicon or selenium, or may be organic photoreceptors using an organic photoconductive material such as phthalocyanine.

In the image forming device 10 shown in FIG. 1, toner images are successively transferred from respective image forming units 12K, 12Y, 12M, and 12C, onto the recording medium P pulled out from the roll, by a known electrophotographic method, and the (superposed) toner images are subjected to light-irradiation fusing by the fixing unit 26 to form an image.

The developing devices 20Y, 20M, 20C, and 20K shown in FIG. 1 are connected to toner cartridges corresponding to respective developing devices (respective colors) via developer supply tubes (not shown). When toner in each toner cartridge is exhausted, the toner cartridge may be replaced.

EXAMPLES

Hereinafter, the exemplary embodiment of the invention will be described in more detail with reference to Examples, but the invention is not limited to the following Examples.

Example 1

—Production of Infrared Absorber A—

An infrared absorber A (squarylium dye) represented by the following Formula (I) is produced according to the following method.

A mixed liquid of 4.843 g of 1,8-diaminonaphthalene (purity: 98%, 30 mmol), 3.863 g of 3,5-dimethylcyclohexanone (purity: 98%, 30 mmol) and 10 mg (0.05 mmol) of p-toluenesulfonic acid monohydrate in 45 ml of toluene is heated while stirring under a nitrogen atmosphere, and is refluxed at 110° C. for 10 hours. Water generated during the reaction is removed by azeotropic distillation. After the completion of the reaction, a dark brown solid obtained by distilling off the toluene is extracted with acetone, purified by recrystallization from a mixed solvent of acetone and ethanol, and then dried to obtain a 4.955 g (62% yield) of an intermediate.

To 4.955 g of the intermediate, a mixed liquid of 913 mg (8.0 mmol) of 3,4-dihydroxycyclobut-3-ene-1,2-dione in 40 ml of n-butanol and 60 ml of toluene is added. The mixture is heated while stirring under a nitrogen atmosphere, and is refluxed at 105° C. for 3 hours. Water generated during the reaction is removed by azeotropic distillation. After the completion of the reaction, most of the solvent is distilled off in the nitrogen atmosphere. Then, to the obtained reaction mixture, 120 ml of hexane is added while stirring. After suction filtration of the generated dark brown precipitate, the filtered precipitate is washed with hexane and dried to obtain a black blue solid. The solid is successively washed with ethanol, acetone, a 60% by weight of an aqueous ethanol solution, ethanol and acetone, thereby obtaining 4.30 g (88% yield) of desired infrared absorber A (perimidine-based squarylium compound (I)) represented by the following Formula (I).

(I)

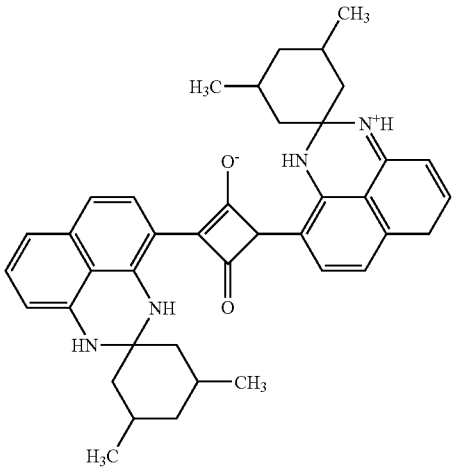

—Production of Color Toner (Color Developer)—

0.5 parts by weight of the infrared absorber A, 95 parts by weight of a polyester resin (condensate of a propylene oxide adduct of bisphenol with fumaric acid, manufactured by Kao Corporation), 5 parts by weight of a pigment (trade name: Pigment Blue 15:3, manufactured by Dainichiseika Color & Chemicals Mfg. Co., Ltd), 1 part by weight of a charge controlling agent (trade name: CCA100, manufactured by Chuo Synthetic Chemical Co., Ltd.), and 0.5 parts by weight of wax (trade name: NP105, manufactured by Mitsui Chemical Co., Ltd.) each are prepared as toner components. The whole amount of the toner components is placed in a Henschel mixer and premixed, and then melt-kneaded by an extruder. Subsequently, the obtained mixture is solidified by cooling, followed by coarse pulverization with a hammer mill and fine pulverization with a jet mill. The obtained fine powder is classified by an air classifier, thereby obtaining blue colored particles (toner particles) having a volume average particle diameter of 8.5 μm. Subsequently, external addition treatment is performed by adding 0.5 parts by weight of hydrophobic silica particles (trade name: H3004, manufactured by Clariant Japan K.K.) to the obtained toner particles by using a Henschel mixer.

The resultant is further mixed with a carrier coated with silicone resin (particle diameter: 50 μm) to obtain a color developer.

—Production of Black Toner (Black Developer)—

95 parts by weight of polyester resin (the same resin as that used for the color toner), 5 parts by weight of pigment (trade name: NIPEX35, manufactured by Evonik Degussa Japan Co., Ltd.), 1 part by weight of charge controlling agent (trade name: CCA100, manufactured by Chuo Synthetic Chemical Co., Ltd.) and 0.5 parts by weight of wax (trade name: NP105, manufactured by Mitsui Chemical Co., Ltd.) each are prepared as toner components. The whole amount of the toner components is placed in a Henschel mixer and premixed, and then melt-kneaded by an extruder Subsequently, the obtained mixture is solidified by cooling, followed by coarse pulverization by a hammer mill and fine pulverization by a jet mill. The obtained fine powder is classified by an air classifier, thereby obtaining black colored particles (toner particles) having a volume average particle diameter of 8.5 μm. Subsequently, external addition treatment is performed by adding 0.5 parts by weight of hydrophobic silica particles (trade name: H3004, manufactured by Clariant Japan K.K.) to the obtained toner particles by using a Henschel mixer.

The resultant is further mixed with a carrier coated with silicone resin (particle diameter: 50 μm) to obtain a black developer.

Evaluation (1) Reflection Spectrum Measurement

The reflection spectra of the color toners obtained as above are obtained with a spectrophotometer (trade name: U-4100, manufactured by Hitachi, Ltd.).

First, a fixed image on paper is obtained with the color developer by using an image forming device (trade name: DOCUCENTRE COLOR 2220, manufactured by Fuji Xerox) equipped with a light source (trade name: HIGHLIGHT ISL-2000L, manufactured by COHERENT) (exposure wavelength: 808 nm) in a light-irradiation fusing device. Subsequently, the reflection spectrum is obtained with the spectrophotometer.

Figure 2:
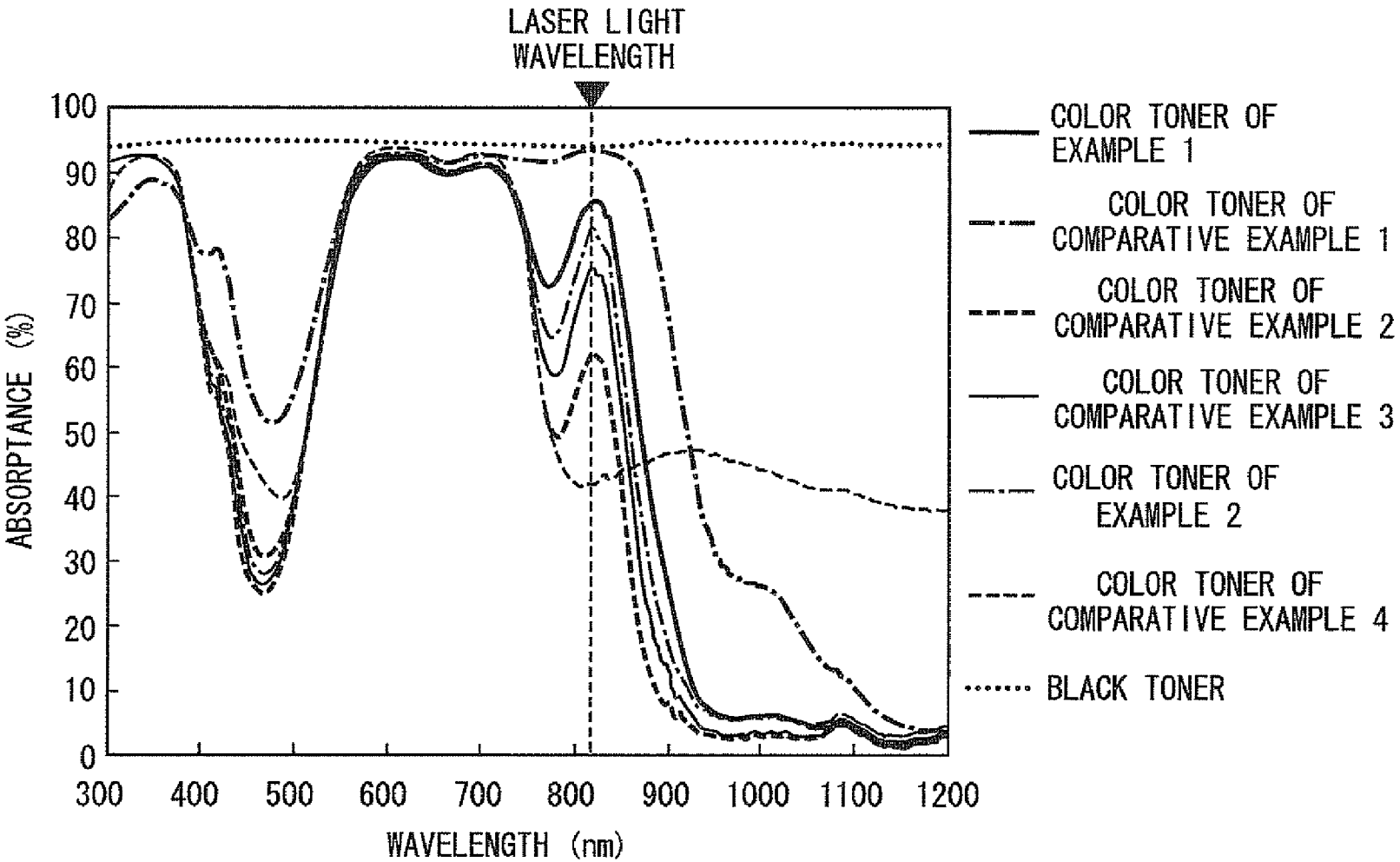
FIG. 2 is a graph showing measurement results of reflection spectra of toners in Examples and Comparative Examples.

The reflection spectrum of the black developer is also measured in a similar manner to the color developer. The results of there measurements are shown in FIG. 2.

(2) Fixability Evaluation (Crease Test)

The fixability of the toner image is evaluated by the crease test below. The crease test is one of the evaluation indices of bending properties of a fixed image or fixability of an image.

First, a fixed image on paper is obtained with the color developer by using an image forming device (trade name: DOCUCENTRE COLOR 2220, manufactured by Fuji Xerox) equipped with a light source (trade name: HIGHLIGHT ISL-2000L, manufactured by COHERENT) (exposure wavelength: 808 nm) in a light-irradiation fusing device. Subsequently, the paper on which the fused image is formed is creased once. The paper is then opened and a creased image area is wiped with cotton. The degree of the image removal is evaluated sensorily and expressed in numerical values. Specifically, an image area having a diameter of 20 mm in which the color toner is a single layer is creased once, and a creased image area is then opened and lightly wiped with cotton. The width of a white deleted area of the image is expressed in units of μm, and a width of 40 μm or less is defined as an acceptable level.

Figure 3:
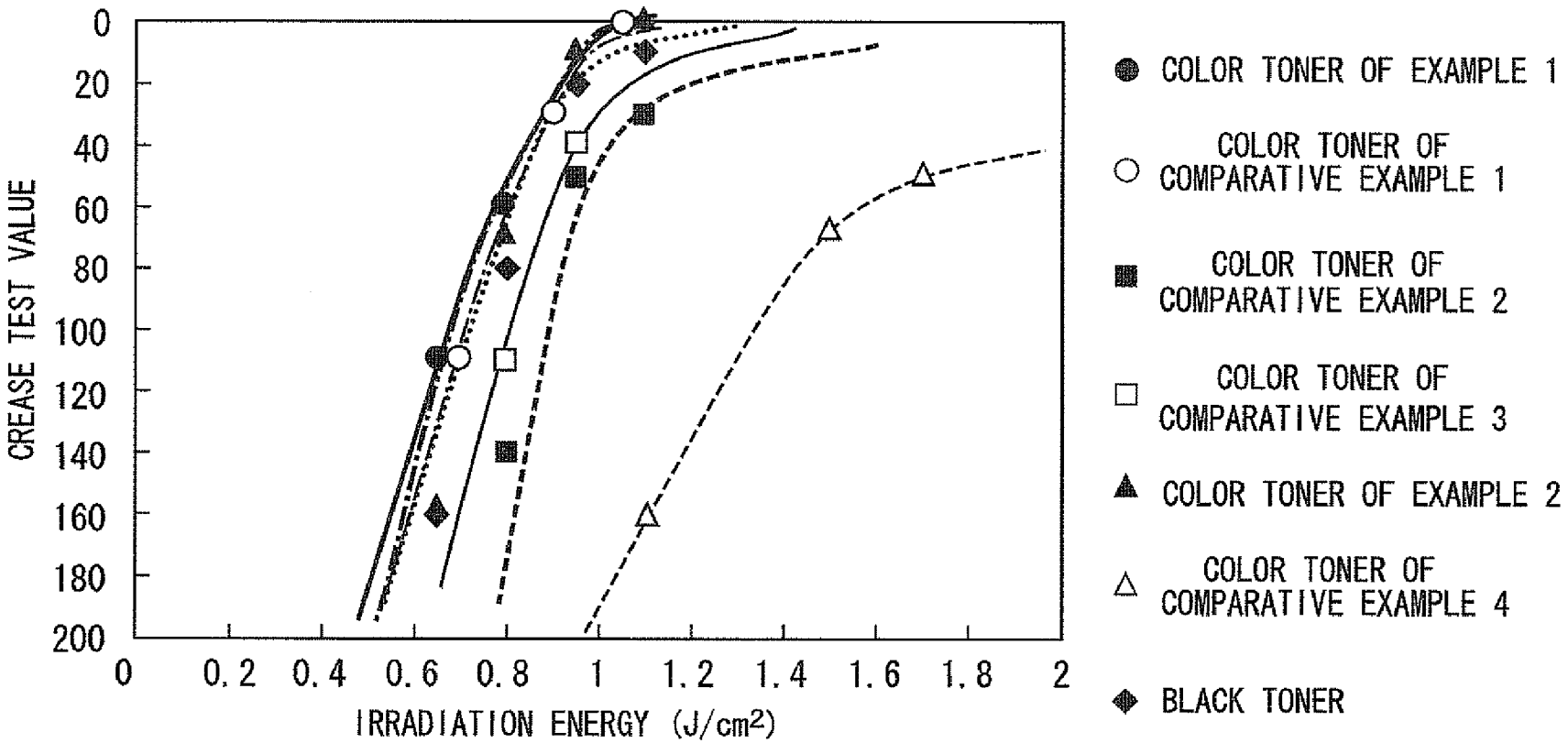
FIG. 3 is a graph showing the results of crease test for the toners of Examples and Comparative Examples.

A smaller numerical value suggests better fixability. The crease test is also conducted on the black developer in a similar manner to the color developer. The results are shown in FIG. 3.

In accordance with the following criteria, the fixability is evaluated based on the numerical values obtained by the crease test. The results are shown in Table 1.

A: Crease test value of 40 or less

B: Crease test value exceeding 40

(3) Color Difference ΔE

First, according to the method in (2) above, a fixed image is formed on paper with the color developer setting the irradiation energy to be 1.0 J/cm$^2$.

Subsequently, a developer is produced using a toner obtained by excluding the infrared absorber from the color toner. A fixed image is obtained according to a method that is the same as the method described in (2) above, except that the paper to which the toner has been transferred is sandwiched between Teflon (registered trademark) sheets and then passed through a pouch laminator (trade name: GLM2500, manufactured by GBC Japan, speed set to level 1, temperature set to 120° C.) in place of fixing by the light-irradiation fusing.

The color evaluation for the fixed image of the color toner containing the infrared absorber and the fixed image of the color toner not containing the infrared absorber is conducted, using a reflection spectrodensitometer (trade name: X-RITE 939, manufactured by X rite Incorporated), by measuring the values of each of $L_1$, $a_1$, $b_1$, $L_2$, $a_2$, and $b_2$ in Equation (1) and calculating the color difference ΔE. The results are shown in Table 1.

Here, ΔE is a color difference as indicated in the CIE1976 L*a*b* colorimetric system. A larger value of ΔE indicates a larger apparent difference in the two colors to be compared.

Comparative Example 1

A color toner and a color developer are produced in a manner substantially similar to Example 1, except that the content of the infrared absorber A in the production of the color toner is changed to 2.0% by weight, and evaluated in a manner substantially similar to Example 1.

Comparative Example 2

A color toner and a color developer are produced in a manner substantially similar to Example 1, except that the content of the infrared absorber A in the production of the color toner is changed to 0.1% by weight, and evaluated in a manner substantially similar to Example 1.

Comparative Example 3

A color toner and a color developer are produced in a manner substantially similar to Example 1, except that the content of the infrared absorber A in the production of the color toner is changed to 0.2% by weight, and evaluated in a manner substantially similar to Example 1.

Example 2

A color toner and a color developer are produced in a manner substantially similar to Example 1, except that the content of the infrared absorber A in the production of the color toner is changed to 0.3% by weight, and evaluated in a manner substantially similar to Example 1.

Comparative Example 4

A color toner and a color developer are produced in a manner substantially similar to Example 1, except that the kind and content of the infrared absorber A in the production of the color toner are changed to diammonium (trade name: IM1, manufactured by Nagase Chemtech Co., Ltd.) and to 0.45% by weight, and evaluated in a manner substantially similar to Example 1.

TABLE 1

| | | Light absorptance (808 nm) | Light absorptance ratio relative to black toner | Fixability evaluation | ΔE |
|---|---|---|---|---|---|
| | Black toner | 95% | — | A | — |
| Example 1 | Infrared absorber A: 0.49% by weight | 84% | 88.42% | A | 10.8 |
| Comparative Example 1 | Infrared absorber A: 2.0% by weight | 93% | 97.89% | A | 24.8 |
| Comparative Example 2 | Infrared absorber A: 0.1% by weight | 59% | 62.11% | B | 5.1 |
| Comparative Example 3 | Infrared absorber A: 0.2% by weight | 72% | 75.79% | B | 6.3 |
| Example 2 | Infrared absorber A: 0.3% by weight | 77% | 81.05% | A | 8.8 |
| Comparative Example 4 | Diimonium: 0.45% by weight | 39% | 41.05% | B | 13.4 |

As shown in FIGS. 2 and 3, the color toner of Comparative Example 1 (to which 2.0% by weight of infrared absorbing agent A has been added; absorptance: 93%) exhibits a high absorptance comparable to that of the black toner (absorptance: 95%) at the laser light wavelength (808 nm) and exhibits excellent fixability (in a crease test) comparable to that of the black toner. However, the color toner of Comparative Example 1 exhibits a considerably larger ΔE value, and thus a favorable color quality cannot be obtained therewith.

Each of the color toners of Example 1 (to which 0.49% by weight of infrared absorber A has been added; absorptance: 84%) and Example 2 (to which 0.3% by weight of infrared absorber A has been added; absorptance: 77%) exhibits lower absorptance than that of the black toner, and exhibits excellent fixability (in a crease test) comparable to that of the black toner. In addition, the color toners of Examples 1 and 2 exhibit a smaller ΔE value, as shown in Table 1, and thus a favorable color quality can be obtained therewith.

In contrast, each of the color toners of Comparative Example 2 (to which 0.1% by weight of infrared absorber A has been added; absorptance: 59%) and Comparative Example 3 (to which 0.2% by weight of infrared absorber A has been added; absorptance: 72%) exhibits a very small ΔE value and thus appears to exhibits a favorable color quality, but exhibits considerably poor fixability. Furthermore, the color toner of Comparative Example 4 (to which 0.45% by weight of diimonium has been added; absorptance: 39%) exhibits considerably poor fixability compared to the black toner.

Figure 4:
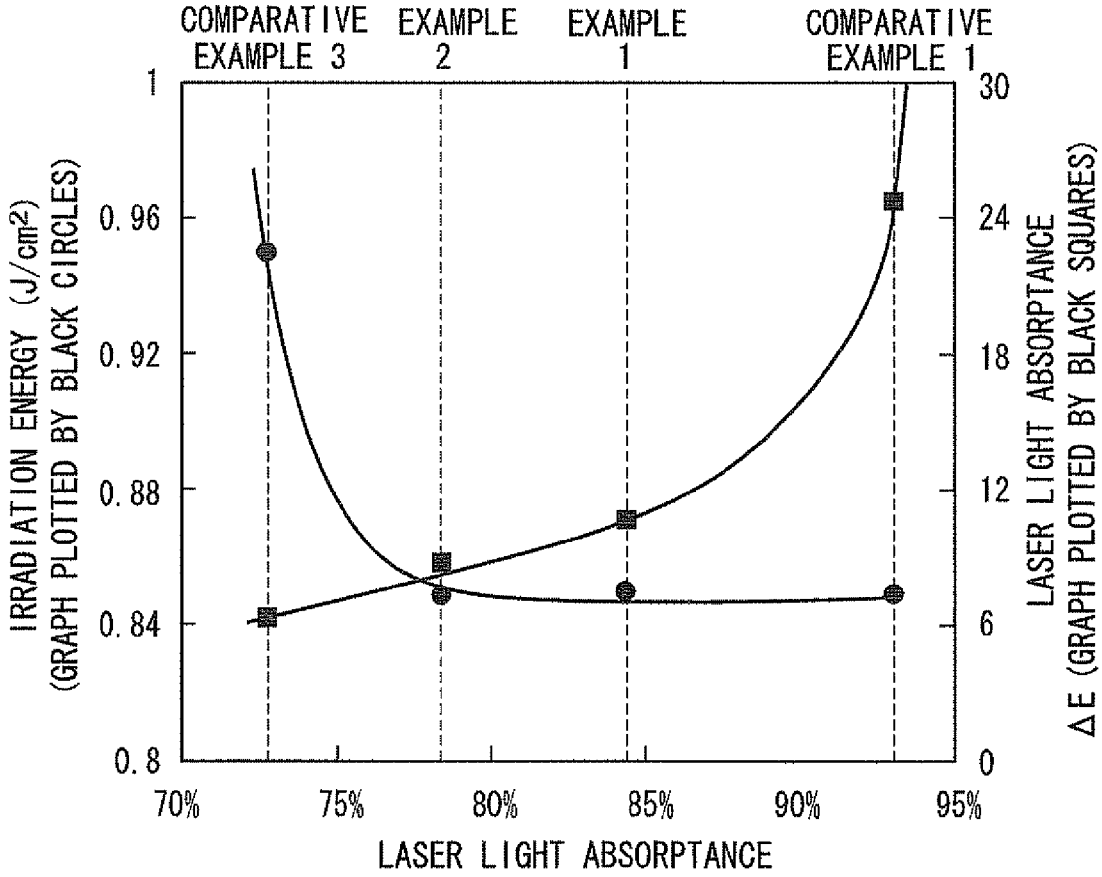
FIG. 4 is a graph showing the relationship between "Laser light absorptance" and "Irradiation energy required for obtaining the numerical value of 40 in the crease test" and the relationship between "Laser light absorptance" and "the value of ΔE obtained when this irradiation energy is applied", in color toners of Examples 1 and 2 and Comparative Examples 1 and 3.

In the color toners of Example 1, Example 2, Comparative Example 1, and Comparative Example 3, the irradiation energy required for obtaining the numerical value of 40 in the crease test is measured and the value of ΔE obtained when this irradiation energy is applied is measured. FIG. 4 shows the relationship between "Laser light absorptance" and "Irradiation energy required for obtaining the numerical value of 40 in the crease test" and the relationship between "Laser light absorptance" and "the value of ΔE obtained when this irradiation energy is applied".

The foregoing description of exemplary embodiments of the present invention has been provided for the purpose of illustration and description. It is not intended to be exhaustive or to limit the invention to the precise forms disclosed. Obviously, many modifications and variations will be apparent to practitioners skilled in the art. For example, plural elements (devices, chemicals, mechanical parts) can be substituted for singular elements in some embodiments of the present invention while single elements can be substituted for plural elements in some embodiments of the present invention. The embodiments were chosen and described in order to best explain the principles of the invention and its applications, thereby enabling others skilled in the art to understand the invention for various embodiments and with the various modifications as are suited to particular use contemplated. It is intended that the scope of the invention be defined by the following claims and their equivalents.

What is claimed is:

1. An image forming method, comprising:

forming at least one electrostatic charge image on a surface of at least one image holding member;

developing the at least one electrostatic charge image using a light-irradiation-fusible black toner and a light-irradiation-fusible color toner to form a black toner image and a color toner image;

transferring the black toner image and the color toner image to a surface of a receiving body; and fixing the black toner image and the color toner image transferred to the surface of the receiving body by light-irradiation fusing with irradiation of light in the infrared region, the black toner being melted by the irradiation of the light in the infrared region in the light-irradiation fusing, the color toner containing an infrared absorber represented by the following Formula (I):

(I)

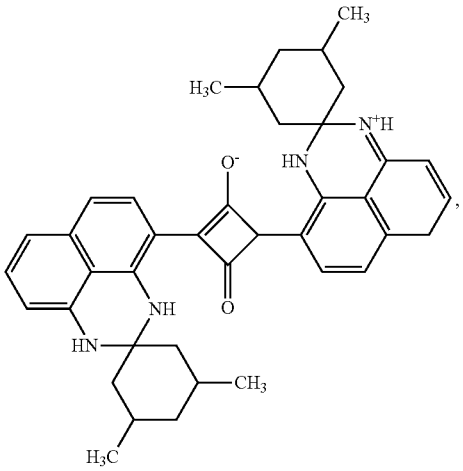

a light absorptance of the color toner at a peak wavelength of the light in the infrared region irradiated in the light-irradiation fusing being from about 79% to about 98% of a light absorptance of the black toner at the peak wavelength, and the color toner having a color difference ΔE represented by the following Equation (1) of about 20 or less, $$\Delta E=\{(L_1-L_2)^2+(a_1-a_2)^2+(b_1-b_2)^2\}^{1/2}, \quad \text{Equation (1)}$$

in Equation (1), $L_2$, $a_2$, and $b_2$ representing an L value, an a value, and a b value of the light-irradiation-fusible color toner in a fixed image, and $L_1$, $a_1$, and $b_1$ representing an L value, an a value, and a b value of a color toner obtained by excluding the infrared absorber from the light-irradiation-fusible color toner, in a fixed image.

2. The image forming method of claim 1, wherein the total content of the infrared absorber is from about 0.3 parts by weight to about 1.0 part by weight with respect to 100 parts by weight of the color toner.

3. The image forming method of claim 1, wherein the light absorptance of the light-irradiation-fusible color toner at a wavelength corresponding to a maximum light absorption peak in the infrared region is from about 75% to about 93%.

4. The image forming method of claim 1, wherein the light absorptance of the light-irradiation-fusible black toner at a wavelength at which the light-irradiation-fusible color toner exhibits the maximum light absorption peak in the infrared region is from about 79% to about 98%.

5. The image forming method of claim 1, wherein the volume average particle diameter of the light-irradiation-fusible color toner is from about 3 μm to about 10 μm.

* * * * *